US010336074B1

(12) United States Patent
Mu et al.

(10) Patent No.: US 10,336,074 B1
(45) Date of Patent: Jul. 2, 2019

(54) INKJET PRINTHEAD WITH HIERARCHICALLY ALIGNED PRINTHEAD UNITS

(71) Applicant: RF Printing Technologies LLC, Pittsford, NY (US)

(72) Inventors: Richard Mu, Irvine, CA (US); Yonglin Xie, Rochester, NY (US)

(73) Assignee: RF PRINTING TECHNOLOGIES, Pittsford, NY (US)

( * ) Notice: Subject to any disclaimer, the term of this patent is extended or adjusted under 35 U.S.C. 154(b) by 12 days.

(21) Appl. No.: 15/874,072

(22) Filed: Jan. 18, 2018

(51) Int. Cl.
*B41J 2/155* (2006.01)
*B41J 2/175* (2006.01)

(52) U.S. Cl.
CPC ..... *B41J 2/155* (2013.01); *B41J 2/175* (2013.01)

(58) Field of Classification Search
CPC ..... B41J 2/155; B41J 2/175; B41J 2202/20; B41J 2002/14491
See application file for complete search history.

(56) References Cited

U.S. PATENT DOCUMENTS 4,520,373 A 5/1985 Ayata et al.
4,559,543 A 12/1985 Toganoh et al.
4,690,391 A 9/1987 Stoffel et al.
4,822,755 A 4/1989 Hawkins et al.
4,961,821 A 10/1990 Drake et al.
4,975,143 A 12/1990 Drake et al.
5,079,189 A 1/1992 Drake et al.
5,257,043 A 10/1993 Kneezel
6,123,410 A 9/2000 Beerling et al.
6,250,738 B1 6/2001 Waller et al.
6,502,921 B2 1/2003 Kanda et al.
6,994,420 B2 2/2006 Silverbrook
7,152,945 B2 12/2006 Silverbrook et al.
7,384,127 B2 6/2008 Silverbrook et al.
8,118,405 B2 * 2/2012 Xie ..... B41J 2/155 347/49
2013/0050315 A1 * 2/2013 Kusakari ..... B41J 2/155 347/9

* cited by examiner

*Primary Examiner* — Lamson D Nguyen
(74) *Attorney, Agent, or Firm* — Gary A. Kneezel

(57) ABSTRACT

A hierarchically aligned inkjet printhead includes a plurality of printhead units and a base holding the printhead units. Each printhead unit includes a plurality of drop ejector array devices, each of which includes at least one drop ejector array; a first butting edge having a first mechanical alignment feature; and a second butting edge having a second mechanical alignment feature. Each printhead unit includes an ink manifold that is fluidically connected to each of the plurality of drop ejector array devices in the printhead unit; and a mounting member to which the drop ejector array devices are affixed. A pair of opposing alignment edges of each printhead unit are substantially parallel to the butting edges of the drop ejector array devices. A first of the opposing alignment edges includes an outwardly-extending projection, and a second of the opposing alignment edges includes a niche that is substantially complementary to the projection.

19 Claims, 13 Drawing Sheets

FIG. 1 – PRIOR ART

FIG. 3 – PRIOR ART

INKJET PRINTHEAD WITH HIERARCHICALLY ALIGNED PRINTHEAD UNITS

FIELD OF THE INVENTION

This invention pertains to the field of inkjet printing and more particularly to wide printhead assemblies including a plurality of aligned printhead units.

BACKGROUND OF THE INVENTION

Inkjet printing is typically done by either drop-on-demand or continuous inkjet printing. In drop-on-demand inkjet printing ink drops are ejected onto a recording medium using a drop ejector including a pressurization actuator (thermal or piezoelectric, for example). Selective activation of the actuator causes the formation and ejection of a flying ink drop that crosses the space between the printhead and the recording medium and strikes the recording medium. The formation of printed images is achieved by controlling the individual formation of ink drops, as is required to create the desired image.

Motion of the recording medium relative to the printhead during drop ejection can consist of keeping the printhead stationary and advancing the recording medium past the printhead while the drops are ejected, or alternatively keeping the recording medium stationary and moving the printhead. The former architecture is appropriate if the drop ejector array on the printhead can address the entire region of interest across the width of the recording medium. Such printheads are sometimes called pagewidth printheads. A second type of printer architecture is the carriage printer, where the printhead drop ejector array is somewhat smaller than the extent of the region of interest for printing on the recording medium and the printhead is mounted on a carriage. In a carriage printer, the recording medium is advanced a given distance along a medium advance direction and then stopped. While the recording medium is stopped, the printhead carriage is moved in a carriage scan direction that is substantially perpendicular to the medium advance direction as the drops are ejected from the nozzles. After the carriage-mounted printhead has printed a swath of the image while traversing the print medium, the recording medium is advanced; the carriage direction of motion is reversed; and the image is formed swath by swath.

A drop ejector in a drop-on-demand inkjet printhead includes a pressure chamber having an ink inlet for providing ink to the pressure chamber, and a nozzle for jetting drops out of the chamber. Two side-by-side drop ejectors are shown in prior art FIG. 1 (adapted from U.S. Pat. No. 7,163,278) as an example of a conventional thermal inkjet drop-on-demand drop ejector configuration. Partition walls 20 are formed on a base plate 10 and define pressure chambers 22. A nozzle plate 30 is formed on the partition walls 20 and includes nozzles 32 (also called orifices herein), each nozzle 32 being disposed over a corresponding pressure chamber 22. The exterior surface of a nozzle plate 30 is called a nozzle face 114 herein. Ink enters pressure chambers 22 by first going through an opening in base plate 10, or around an edge of base plate 10, and then through ink inlets 24, as indicated by the arrows in FIG. 1. A heating element 35, which functions as the actuator, is formed on the surface of the base plate 10 within each pressure chamber 22. Heating element 35 is configured to selectively pressurize the pressure chamber 22 by rapid boiling of a portion of the ink in order to eject drops of ink through the nozzle 32 when an energizing pulse of appropriate amplitude and duration is provided.

Developments within the inkjet printing industry have increased the importance of wide printhead assemblies where the drop ejector array on the printhead can address the entire region of interest across the width of the recording medium. Although carriage printers are suitable for home and small office use, higher speed printers using pagewidth printheads are more suitable for networked printers for larger offices. A second development within the inkjet printing industry is the increased use of commercial printing. Commercial inkjet printers are capable of printing high volumes of pages at high printing throughput. A third development is the use of industrial inkjet printers for textile printing, decorative printing, graphic arts and 3D printing. Such printing systems can require print areas that are greater than one meter in width. Further printing applications that can benefit from wide printhead assemblies include deposition of biological materials, as well as functional printing of electronic circuitry.

Drop ejector arrays are typically formed using fabrication technologies developed for micro-electro-mechanical systems (MEMS) and integrated circuits. The present largest size of commercially available silicon wafers is about 30 centimeters in diameter. Although it would be possible to make pagewidth printheads having a width less than 30 centimeters using a single printhead die from such a wafer, manufacturing yield is such that it is economically advantageous to assemble a pagewidth printhead using printhead dies that are on the order of 1 centimeter wide. The drop ejector arrays on each of the printhead dies need to be well-aligned with each other. Otherwise there will be unacceptable defects in printed images, such as white streaks resulting from endmost drop ejectors on two adjacent printhead dies being too far apart from one another.

Two generic configurations of printhead assemblies are those that use overlapping printhead dies and those that use butted printhead dies. In an assembly of overlapping printhead dies each printhead die is longer than Nd, where N is the number of drop ejectors in the array on a single printhead die, and d is the distance along the array direction between adjacent drop ejectors. As a result, such printhead assemblies cannot have adjacent printhead dies arranged end-to-end because an unacceptable gap would result between endmost drop ejectors on adjacent printhead dies. A variety of ways have been disclosed for accommodating the printhead die length in an assembly of overlapping printhead dies while still providing an arrangement of drop ejectors that can print acceptable images.

U.S. Pat. No. 4,520,373 discloses a pagewidth printhead including overlapping printhead dies that are alternately adhered on both sides of a metal heat sink. This configuration is compatible with drop ejector geometries where the nozzles are formed in an edge of the device. U.S. Pat. No. 4,559,543 discloses a similar configuration where each printhead unit is detachably mounted in staggered fashion on opposite sides of a support bar so that damaged printhead units can be replaced. Complex adjustment capability is built into the print bar for aligning the printhead units. U.S. Pat. No. 5,257,043 discloses a similar configuration where modular printhead units are arranged in staggered fashion on opposite faces of a support bar. The printhead units are releasably positioned on the support bar by mechanical contact of the printhead against either external jigging or patterned features that are permanently fabricated on the support bar faces.

For drop ejector geometries where the nozzles are formed in a face of the device, the printhead dies can be aligned in multiple rows on a single surface of a carrier substrate. Such an arrangement is disclosed in U.S. Pat. No. 6,250,738 where a scalable printhead is formed by mounting an ink manifold and multiple thermal inkjet printhead dies to a carrier substrate. The carrier substrate is machined to include through-slots for providing ink passageways between the ink manifold and each printhead die. Alignment of the printhead dies is accomplished by solder reflow forces that cause precisely located wetting metal patterns on the printhead dies to line up with corresponding precisely located wetting metal patterns on the carrier substrate, as disclosed in U.S. Pat. No. 6,123,410.

U.S. Pat. No. 7,384,127 discloses an alternative alignment approach for staggered rows of printhead dies. Each printhead die is affixed within a recess of a corresponding precision micro-molded printhead segment carrier. The printhead segment carriers have stepped ends for nesting in alternating orientation to provide an overlapping staggered arrangement of printhead dies. Lengthwise alignment between successive printhead segment carriers is accomplished by positioning the carriers using fiducial marks on the front surface of each of the printhead dies. The carriers are then bonded in position along a support.

A different configuration for accommodating overlapping printhead dies is to position each printhead die at an angle with respect to a straight line running the length of the printing zone, thereby enabling overlap of the ends of adjacent printhead dies, as disclosed in U.S. Pat. No. 6,994,420. The printhead dies are positioned in carriers and include fiducials in the form of markers to facilitate accurate alignment. U.S. Pat. No. 7,152,945 discloses that firing of the diagonally overlapping printhead dies can be adjusted digitally during printing rather than relying on very close tolerances for alignment.

For printhead dies having a length that is substantially equal to Nd, the printhead dies can be butted end to end without an unacceptable gap between endmost drop ejectors of adjacent printhead dies. Various alignment schemes have been disclosed for printhead assemblies using butted printhead dies. The drop ejectors are arranged along a single direction rather than being overlapping, offset and staggered. Arrangement of the drop ejectors along a single direction is preferable for facilitating precision alignment, for compactness of the wide printhead assembly, and for ease of image processing.

U.S. Pat. No. 4,690,391 discloses a method and apparatus where each buttable die is provided with a pair of V-shaped locating grooves in its face. An aligning tool has pin-like projections that are insertable into the locating grooves, so that the aligning tool is used to position a series of the dies in end-to-end fashion. Vacuum ports in the aligning tool draw the dies into tight face-to-face contact with the tool. A suitable base is then affixed to the aligned dies and the aligning tool is withdrawn. As pointed out in U.S. Pat. No. 4,975,143, a limitation with the aligning tool of '391 is that the accuracy of the location of the dies is a function of the accuracy with which the alignment structures can be formed on the tool. An improvement disclosed in '143 is that the alignment pattern on the alignment tool is formed in a photo-patternable or electroformable material for improved accuracy of the alignment tool.

As described above with reference to '391, in some printhead assemblies the printhead dies are all directly bonded to a common base. U.S. Pat. No. 5,079,189 discloses an alternative configuration where each die is mounted separately on a planar support to form a subunit. The width of the support is less than the width of the die, so that the side edges of the die extend outwardly beyond the side edges of the planar support. Subunits are aligned on a substrate bar by butting the extending side edges of the die in adjacent subunits, and by butting the front edges against an alignment tool.

Forming butting edges without damage and at precise locations relative to the drop ejectors is important. U.S. Pat. No. 4,822,755 discloses a method for separating dies formed on a silicon substrate using reactive ion etching techniques combined with orientation dependent etching or dicing to yield integrated circuit dies having edges that can be more precisely butted together.

Mechanical contact of plain butting edges of two adjacent printhead die can be effective in providing alignment of drop ejectors along the array direction, but it is not effective in providing alignment in a direction perpendicular to the array direction. U.S. Pat. No. 6,502,921 discloses a printhead die configuration having a protruded abutting portion and a recessed abutting portion that is shaped to engage a protruded abutting portion that is formed on another printhead die.

U.S. Pat. No. 8,118,405 discloses alignment features including one or more projections on one butting edge and corresponding indentations on the opposite butting edge of the printhead die. The projections are sized to fit into the indentations of an adjacent printhead die such that when the projections contact the indentations of the adjacent printhead die, the two printhead dies are aligned relative to one another in two dimensions. Projections and indentations can have a variety of shapes, including triangular, trapezoidal or rounded as long as the indentations of one printhead die have the proper shape and dimensions to contact the projections of the adjacent printhead die and provide relative alignment. The projections and indentations can have complementary shapes.

Because wide printhead assemblies are expensive to fabricate, it is advantageous to assemble the wide printhead using a plurality of readily replaceable printhead units. Then, if a printhead unit is damaged, the quality of the wide printhead assembly can be restored by replacing the damaged printhead unit. It is particularly advantageous if the printhead units can be field replaceable. Replacing printhead subunits in the field should not require optical alignment, external jigging or complex position adjustment to align the new printhead unit. Mechanical alignment using complementary features is well-suited to this. The alignment tolerances between adjacent printhead dies are typically less than ten microns in order to provide good image quality. Mechanical alignment features providing such tolerances with respect to the drop ejectors need to be formed directly on the printhead dies that contain the drop ejectors. Such mechanical alignment features on the printhead dies need to be small so that they will not interfere with drop ejectors, ink passageways or electronics on the printhead dies. However, such small mechanical alignment features formed on the printhead dies can be fragile.

What are needed are alignment structures and methods of assembly for forming wide printhead assemblies using a plurality of printhead units that can be readily and precisely aligned to provide drop ejectors that are arranged along a single direction. Furthermore, what are needed are structures that help to protect the complementary mechanical alignment features on the printhead dies from damage.

SUMMARY OF THE INVENTION

According to an aspect of the present invention, a hierarchically aligned inkjet printhead includes a plurality of printhead units and a base having a support surface that holds the plurality of printhead units. Each printhead unit includes a plurality of drop ejector array devices, each of which includes a substrate having a substrate surface; at least one drop ejector array formed on the substrate surface; a first butting edge having a first mechanical alignment feature; and a second butting edge having a second mechanical alignment feature. Each printhead unit also includes an ink manifold that is fluidically connected to each of the plurality of drop ejector array devices in the printhead unit; and a mounting member to which each of the plurality of drop ejector array devices in the printhead unit are affixed. A pair of opposing alignment edges of each printhead unit are substantially parallel to the first butting edges and the second butting edges of the plurality of drop ejector array devices. A first of the opposing alignment edges includes an outwardly-extending projection, and a second of the opposing alignment edges includes a niche that is substantially complementary to the projection.

According to another aspect of the present invention, a hierarchically aligned inkjet printhead includes a plurality of printhead units and a base having a support surface that holds the plurality of printhead units. Each printhead unit includes at least one drop ejector array device, each of which includes a substrate having a substrate surface; at least one drop ejector array formed on the substrate surface; a first butting edge having a first mechanical alignment feature; and a second butting edge having a second mechanical alignment feature. Each printhead unit also includes an ink manifold that is fluidically connected to each of the at least one drop ejector array devices in the printhead unit; and a pair of opposing alignment edges that are substantially parallel to the first butting edge and the second butting edge of the at least one drop ejector array device. A first of the opposing alignment edges includes an outwardly-extending projection, and a second of the opposing alignment edges includes a niche that is substantially complementary to the first projection.

According to another aspect of the present invention, a method is provided for assembling a hierarchically aligned inkjet printhead. The method includes assembling a plurality of printhead units. Each printhead unit is assembled by affixing a plurality of drop ejector array devices to a mounting member, where adjacent drop ejector array devices in the printhead unit are butted end to end at adjacent butting edges, and are mechanically aligned using mechanical alignment features on the butting edges of the drop ejector array devices. The mounting member is affixed to an ink manifold such that the ink manifold is fluidically connected to each of the drop ejector array devices in the printhead unit. The method further includes positioning a first printhead unit on a base by loosely engaging a plurality of first locating features on the first printhead unit with a corresponding first plurality of second locating features on the base; positioning a second printhead unit on the base by loosely engaging a plurality of first locating features on the second printhead unit with a corresponding second plurality of second locating features on the base; and pushing the second printhead unit, thereby producing a relative motion toward the first printhead unit. The relative motion is guided during a first time interval by inserting an outwardly extending projection of a first alignment edge of the first printhead unit into a substantially complementary niche in an adjacent second alignment edge of the second printhead unit. The method further includes continuing to push the second printhead unit toward the first printhead unit until a mechanical alignment feature on an endmost first butting edge of the first printhead unit interlocks with an adjacent substantially complementary mechanical alignment feature on an endmost second butting edge of the second printhead unit; and securing the first printhead unit and the second printhead unit to the base.

This invention has the advantage that a wide inkjet printhead assembly can be formed using a plurality of printhead units that can be readily and precisely aligned to provide drop ejectors that are arranged along a single direction. A further advantage is that structures are provided to protect the mechanical alignment features on the printhead dies from damage.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

Figure 2:
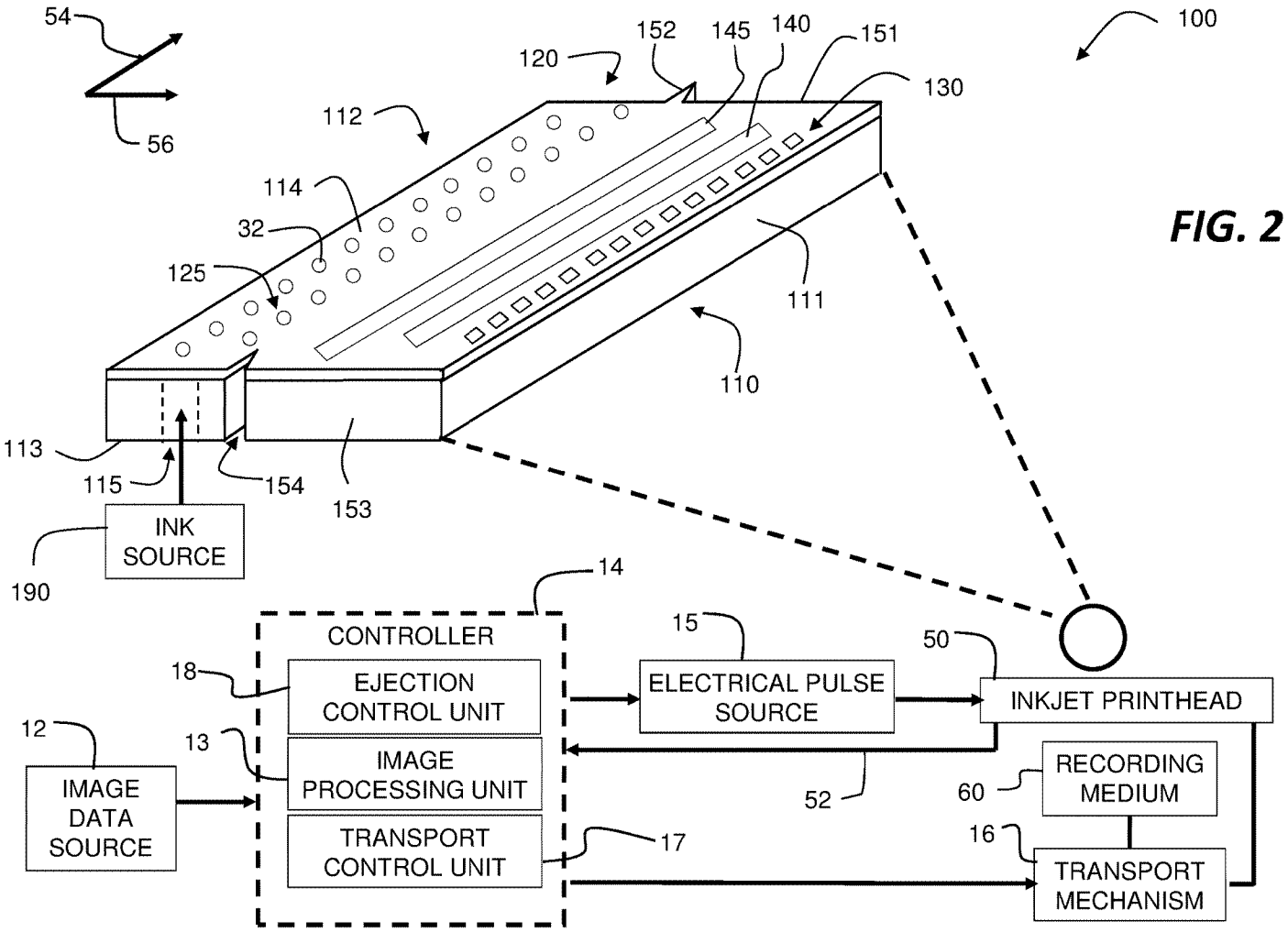
FIG. 2 is a schematic representation of a portion of an inkjet printing system according to an embodiment.

FIG. 2 shows a schematic representation of a portion of an inkjet printing system 100 together with a perspective of drop ejector array device 110, according to an embodiment of the present invention. Drop ejector array device 110 can also be called a printhead die. Image data source 12 provides image data signals that are interpreted by a controller 14 as commands for ejecting drops. Controller 14 includes an image processing unit 13 for rendering images for printing. The term "image" is meant herein to include any pattern of dots directed by the image data. It can include graphic or text images. It can also include patterns of dots for printing functional devices or three dimensional structures if appropriate inks are used. Controller 14 also includes a transport control unit 17 for controlling transport mechanism 16 and an ejection control unit 18 for ejecting ink drops to print a pattern of dots corresponding to the image data on the recording medium 60. Controller 14 sends output signals to an electrical pulse source 15 for sending electrical pulse waveforms to an inkjet printhead 50 that includes at least one drop ejector array module 110. A printhead output line 52 is provided for sending electrical signals from the printhead 50 to the controller 14 or to sections of the controller 14, such as the ejection control unit 18. For example, printhead output line 52 can carry a temperature measurement signal from printhead 50 to controller 14. Transport mechanism 16 provides relative motion between inkjet printhead 50 and recording medium 60 along a scan direction 56. Transport mechanism 16 is configured to move the recording medium 60 along scan direction 56 while the printhead 50 is stationary in some embodiments. Alternatively, transport mechanism 16 can move the printhead 50, for example on a carriage, past stationary recording medium 60. Various types of recording media for inkjet printing include paper, plastic, and textiles. In a 3D inkjet printer, the recording media include a flat building platform and a thin layer of powder material. In addition, in various embodiments recording medium 60 can be web fed from a roll or sheet fed from an input tray.

Figure 1:
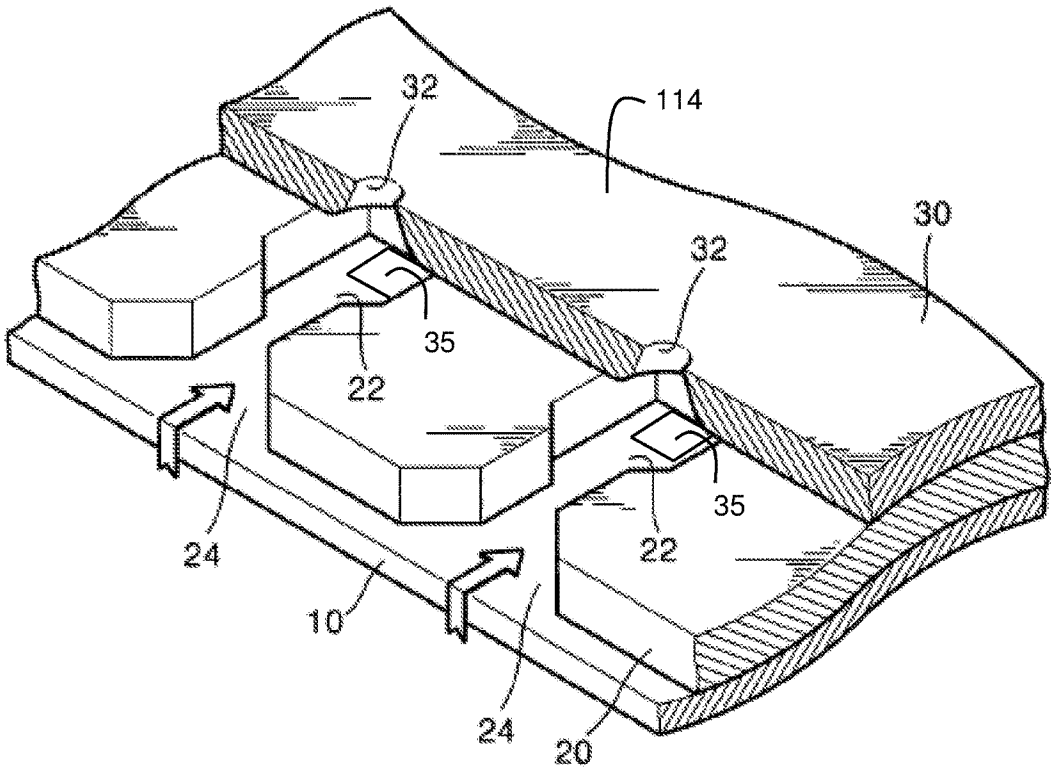
FIG. 1 shows a perspective of a prior art drop ejector configuration.

Drop ejector array device 110 includes at least one drop ejector array 120 having a plurality of drop ejectors 125 formed on a top surface 112 of a substrate 111 that can be made of silicon or other appropriate material. In the example shown in FIG. 2, drop ejector array 120 includes a pair of rows of drop ejectors 125 that extend along array direction 54 and that are staggered with respect to each other in order to provide increased printing resolution. Ink is provided to drop ejectors 125 by ink source 190 through ink feed 115 which extends from the back surface 113 of substrate 111 toward the top surface 112. Ink source 190 is generically understood herein to include any substance that can be ejected from an inkjet printhead drop ejector. Ink source 190 can include colored ink such as cyan, magenta, yellow or black. Alternatively ink source 190 can include conductive material, dielectric material, magnetic material, or semiconductor material for functional printing. Ink source 190 can alternatively include biological or other materials. For simplicity, location of the drop ejectors 125 is represented by the circular nozzle 32. Nozzle face 114 is the exterior surface through which the nozzles 32 extend. Not shown in FIG. 2 are the pressure chamber 22, the ink inlet 24, or the actuator 35 (FIG. 1). Ink inlet 24 is configured to be in fluidic communication with ink source 190. The pressure chamber 22 is in fluidic communication with the nozzle 32 and the ink inlet 24. The actuator 35, e.g. a heating element or a piezoelectric element, is configured to selectively pressurize the pressure chamber 22 for ejecting ink through the nozzle 32. Drop ejector array device 110 includes a group of input/output pads 130 for sending signals to and sending signals from drop ejector array device 110 respectively. Also provided on drop ejector array device 110 are logic circuitry 140 and driver circuitry 145. Logic circuitry 140 processes signals from controller 14 and electrical pulse source 15 and provides appropriate pulse waveforms at the proper times to driver circuitry 145 for actuating the drop ejectors 125 of drop ejector array 120 in order to print an image corresponding to data from image processing unit 13. Logic circuitry 140 sequentially selects one or more drop ejectors in the drop ejector array to be actuated. Groups of drop ejectors 125 in the drop ejector array 120 are fired sequentially so that the capacities of the electrical pulse source 15 and the associated power leads are not exceeded. A group of drop ejectors 125 is fired during a print cycle. A stroke is defined as a plurality of sequential print cycles, such that during a stroke all of the drop ejectors 125 of drop ejector array 120 are addressed once so that they have opportunity to be fired once based upon the image data. Logic circuitry 140 can include circuit elements such as shift registers, gates and latches that are associated with inputs for functions including providing data, timing, and resets.

Drop ejector array device 110 includes a first butting edge 151 and a second butting edge 153 that is opposite the first butting edge 151. First butting edge 151 includes a first mechanical alignment feature 152, and second butting edge 153 includes a second mechanical alignment feature 154. In the example shown in FIG. 2, the first mechanical alignment feature 152 is a feature that juts outwardly from first butting edge 151, and the second mechanical alignment feature 154 is an indentation in second butting edge 153. The shapes of first mechanical alignment feature 152 and second mechanical alignment feature 154 are substantially complementary. In this way, when drop ejector array devices 110 are arranged end-to-end at their butting edges, alignment is provided by mechanical contact between first mechanical alignment features 152 and second mechanical alignment features 154 on adjacent drop ejector array devices, as disclosed in U.S. Pat. No. 8,118,405. Because the size of the first and second mechanical alignment features 152 and 154, as well as their locations relative to the drop ejector array 120, can be precisely controlled using wafer processing methods such as deep reactive ion etching, alignment tolerances of less than 10 microns can be readily achieved.

Figure 3:
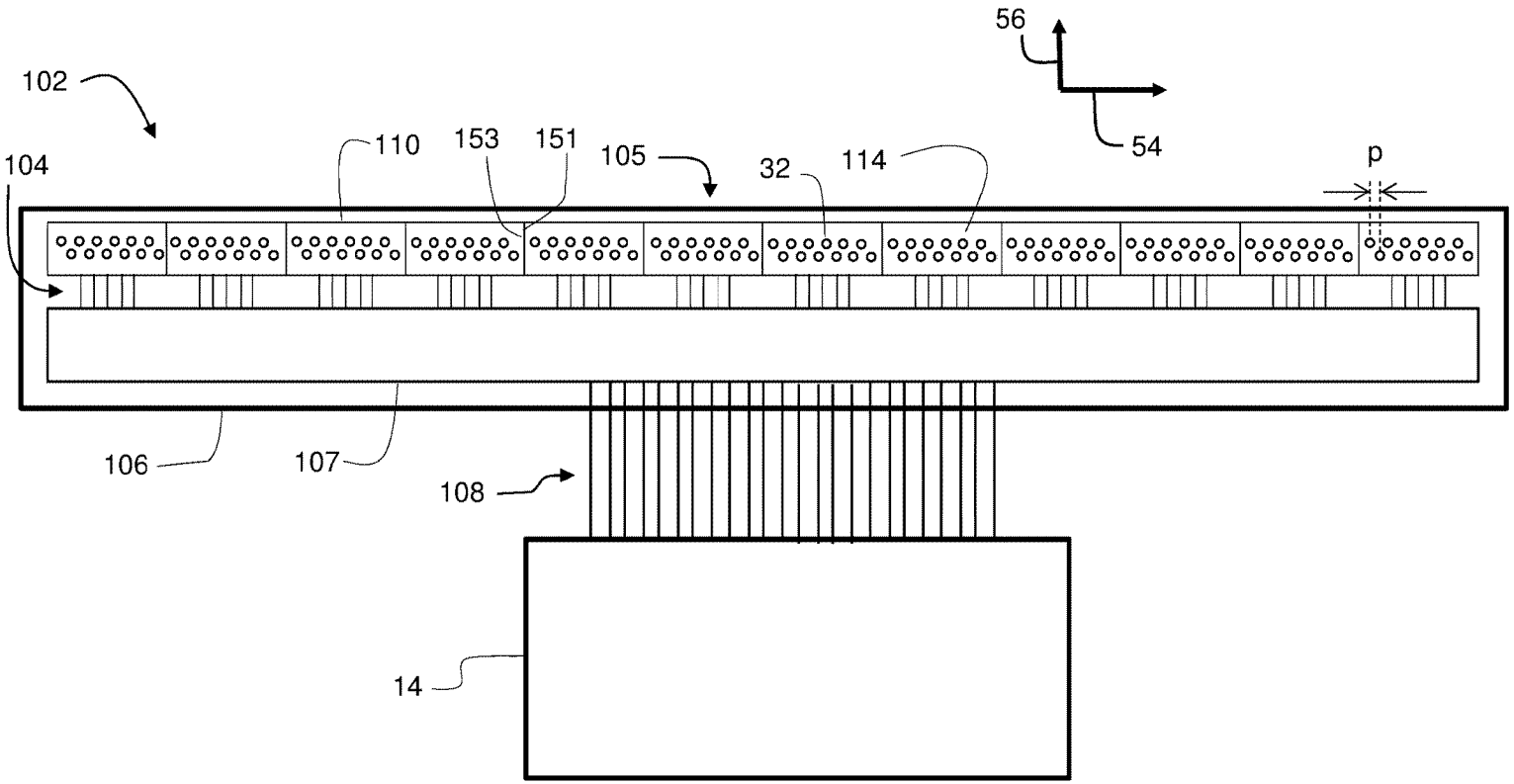
FIG. 3 shows a schematic of a portion of a prior art inkjet printing system having a pagewidth printhead with a plurality of drop ejector array modules.

FIG. 3 shows a schematic of a portion of a prior art inkjet printing system 102 having a pagewidth printhead 105 including a plurality of drop ejector array devices 110 that are arranged end-to-end along array direction 54 and affixed to mounting substrate 106. Nozzle face 114 has nozzles 32 arranged along array direction 54 in two rows that are staggered by pitch p with odd numbered nozzles 32 in an upper row and even numbered nozzles 32 in a lower row. The distance along the array direction 54 between a nozzle 32 in the upper row and an adjacent nozzle 32 in the lower row is pitch p. By properly timing the firing of nozzles in the upper row and the lower row, a printing dot pitch p in the array direction 54 is provided. An interconnection board 107 is mounted on mounting substrate 106 and is connected to each of the drop ejector array devices 110 by interconnects 104 that can be wire bonds or tape automated bonding leads for example. A printhead cable 108 connects the interconnection board 107 to the controller 14. Recording medium 60 (FIG. 2) is moved along scan direction 56 by transport mechanism 16 (FIG. 2) for printing. Controller 14 controls the various functions of the inkjet printing system as described above with reference to FIG. 2. Ink connections to the drop ejector array devices 110 in pagewidth printhead 105 are not shown in FIG. 3. For simplicity mechanical alignment features are not shown on the butting edges 151 and 153 of drop ejector array devices 110 in FIG. 3.

Rather than relying solely on mechanical alignment features on the butting edges of the drop ejector array devices in the fashion disclosed in U.S. Pat. No. 8,118,405, embodiments of the present invention use a hierarchical mechanical alignment approach. In other words, a set of coarse mechanical alignment features is used to provide approximate alignment of one printhead unit relative to another. Then one or more sets of finer mechanical alignment features are successively used to guide more precise alignment of the drop ejector array devices in the different printhead units.

Figure 4:
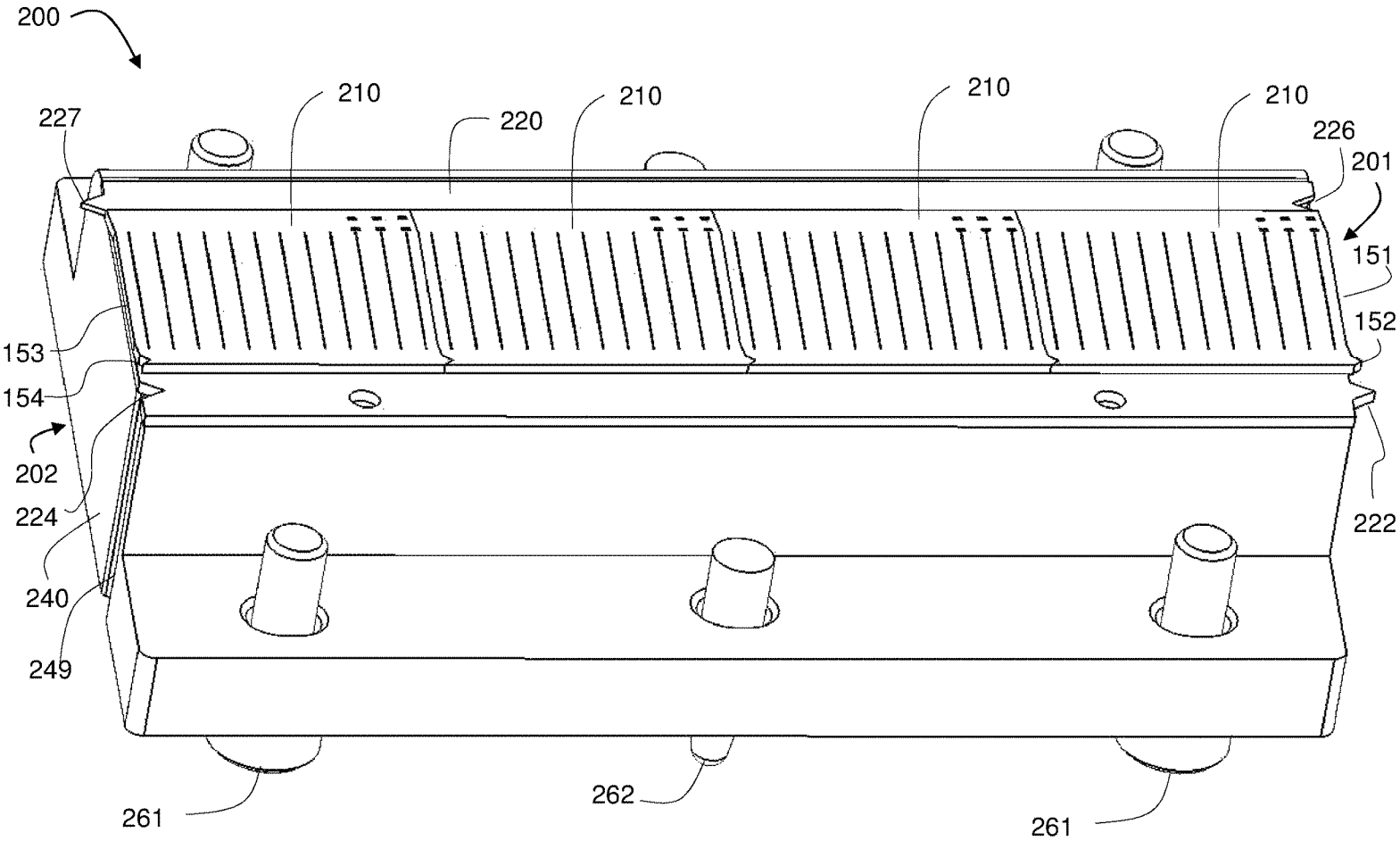
FIG. 4 shows perspective of a printhead unit according to an embodiment.

FIG. 4 shows a perspective of a printhead unit 200 according to an embodiment, together with a set of screws 261 and dowel pins 262 that are used to attach the printhead unit 200 to a base 280 (FIG. 9) as described below with reference to FIGS. 9-11. In the example shown in FIG. 4, printhead unit 200 includes four drop ejector array devices 210. Each drop ejector array device 210 includes a first butting edge 151 having a first mechanical alignment feature 152 and a second butting edge 153 having a second mechanical alignment feature 154. The four drop ejector array devices 210 are affixed to a mounting member 220. An ink manifold 240 is fluidically connected through the mounting member 220 to each of the drop ejector array devices 210. Printhead unit 200 has a pair of opposing alignment edges 201 and 202 that are substantially parallel to the first butting edge 151 and the second butting edge 153 of the drop ejector array devices 210. A first opposing alignment edge 201 of the printhead unit 200 includes an outwardly-extending projection 222. A second opposing alignment edge 202 of the printhead unit 200 includes an inwardly-extending niche 224 having a shape that is substantially complementary to the outwardly-extending projection 222. In addition, projection 227 extends outwardly from the second opposing alignment edge 202 of printhead unit 200, and niche 226, having a substantially complementary shape to projection 227, extends inwardly at a corresponding location from the first opposing alignment edge 201 of printhead unit 200. In the example shown in FIG. 4, the outwardly-extending projections 222 and 227 and the niches 224 and 226 of printhead unit 200 are formed as part of the mounting member 220.

Printhead unit 200 also includes a pair of clearance grooves 249 in manifold 240. A first clearance groove 249 is aligned with niche 224 and is described below with reference to FIGS. 12A and 12B. A second clearance groove 249 (mostly hidden from view in FIG. 4) is aligned with niche 226 and allows projection 227 of an adjacent printhead unit 200 to pass freely during assembly or disassembly of printhead units 200 in a printhead 300.

Figure 5A:
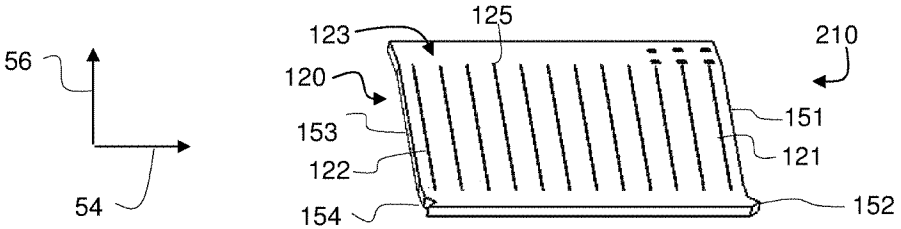
FIG. 5A shows an individual drop ejector array device.

FIG. 5A shows an individual drop ejector array device 210. In this embodiment drop ejector array 120 has twelve columns of drop ejectors 125 (FIG. 2) including a first end column 121 near the first butting edge 151, a second end column 122 near the second butting edge 153, and ten interior columns 123 between the first end column 121 and the second end column 122. Each column can include many (e.g. twenty or more) drop ejectors 125. Adjacent drop ejectors in each column are separated by pitch p (FIG. 2) along array direction 54. In addition, the bottom-most drop ejector 125 in each column (e.g. second end column 122) is separated along the array direction 54 from the top-most drop ejector 125 in the adjacent column (e.g. the left-most interior column 123) by pitch p. By properly timing the firing of the drop ejectors 125, drop ejector array device 210 can provide a printing dot pitch p along the array direction 54 across the entire drop ejector array 120.

Figure 5B:
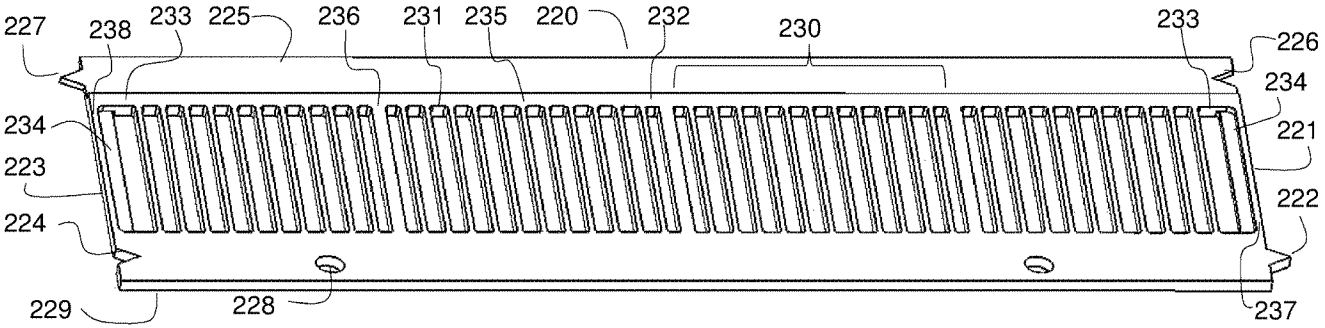
FIG. 5B shows a mounting member that is configured to hold four drop ejector array devices.

FIG. 5B shows a mounting member 220 that is configured to hold four drop ejector array devices 210 (as in FIG. 4), but without any drop ejector array devices 210 affixed to its mounting surface 225. Projection 222 extends outwardly from a first alignment edge 221 of the mounting member 220. Niche 224, having a substantially complementary shape to projection 222, extends inwardly at a corresponding location from an opposing second alignment edge 223 of the mounting member 220. In addition, projection 227 extends outwardly from the second alignment edge 223, and niche 226, having a substantially complementary shape to projection 227, extends inwardly at a corresponding location from the first alignment edge 221. As described below, if two mounting members 220 are placed end to end, the niche 224 of a first mounting member 220 will accommodate the projection 222 of the adjacent mounting member 220, and the projection 227 of the first mounting member 220 will fit into the niche 226 of the adjacent mounting member, thereby helping to guide the alignment between the two mounting members 220.

Mounting member 220 includes four groups 230 of ink passages 231 to provide ink from manifold 240 (FIG. 4) to the four drop ejector array devices 210 that will be affixed to mounting member 220. In the embodiment shown in FIGS. 5A-5C, the different ink passages 231 in each group provide ink to the different columns 121, 122 and 123 of drop ejectors 125 on the corresponding drop ejector array 210. Ribs 235 are provided between adjacent ink passages 231 in a group 230 in order to increase the strength of mounting member 220, as well as to provide additional support for the corresponding drop ejector array device 210. In other embodiments (not shown) each group 230 includes a single ink passage that extends along array direction 54 without any strengthening ribs 235. Thus each group 230 includes at least one ink passage member.

Figure 6:
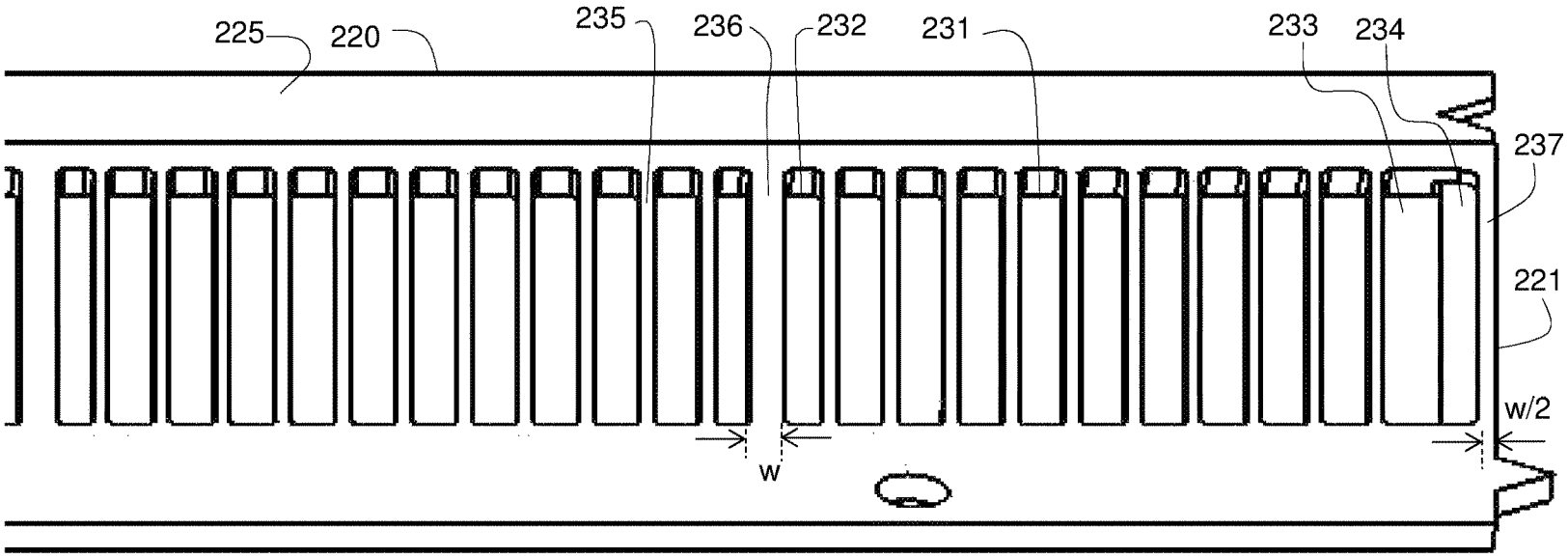
FIG. 6 shows a close-up view of a portion of a mounting member.

With reference also to the close-up view of a portion of mounting member 220 shown in FIG. 6, between adjacent groups 230 of ink passages 231 is an interior bridge 236 that is typically wider than a rib 235. To provide the space for the wider interior bridge 236, the group end ink passages 232 at the ends of a group 230 are made narrower than the ink passages 231 that are between the group end ink passages 232. Interior bridge 236 provides additional area on mounting surface 225 for making a reliable fluid seal at the butting edges 151 and 153 of drop ejector array devices 210 (FIG. 5A). In order to provide a fluid seal, a flowable sealant material is typically applied to the mounting surface 225 of the mounting member 220. The sealant material is selected for its adhesive properties as well as its compatibility with the ink. The back surface 113 (FIG. 2) of the drop ejector array device 210 is adhered by the sealant material to the mounting surface 225 of the mounting member 220.

In the embodiment shown in FIG. 5B, the two groups 230 at the central part of mounting member 220 each include twelve ink passages 231 and 232, corresponding to the twelve columns of drop ejectors 125 on the drop ejector array devices 210. However, the groups 230 near the first alignment edge 221 and the second alignment edge 223 of mounting member 220 only have eleven ink passages. The mounting member end ink passages 233 each provide ink to two columns of drop ejectors 125. The two mounting member end ink passages 233 respectively include a partial-depth step 234 to provide ink to the first end column 121 of drop ejectors 125 on the right-most drop ejector array device 211 on the mounting member 220 (FIG. 5C) and a partial-depth step 234 to provide ink to the second end column 122 of drop ejectors 125 on the left-most drop ejector array device 214 on the mounting member 220. By having partial-depth steps 234 for providing ink to the first and second end columns 121 and 122, a larger sealing area is provided between the back surface 229 of mounting member 220 and the interface surface 241 (FIG. 7) of manifold 240.

A first endmost bridge 237 is provided between the step 234 and the respective first alignment edge 221, and is configured to provide a sealing surface for an endmost first butting edge 155 (FIG. 5C) of drop ejector array device 211. A second endmost bridge 238 is provided between the opposite step 234 and the second alignment edge 223, and is configured to provide a sealing surface for an endmost second butting edge 156 (FIG. 5C) of drop ejector array device 214. As shown in FIG. 6, if the wall width of interior bridge 236 is equal to w, the wall width of the first and second endmost bridges 237 and 238 is less than w. In the example shown in FIG. 6 the endmost bridge wall width is w/2. This allows adjacent mounting members 220 with affixed drop ejector array devices 211, 212, 213 and 214 (FIG. 5C) to be placed end to end as described below. By using a partial depth step 234 to extend the mounting member end ink passages 233 so that they are wide enough at the mounting surface 225 to provide ink to the columns of drop ejectors 125 near the alignment edges, the endmost bridges 237 and 238 are strengthened relative to what they would be if the mounting member end ink passages 233 were made wider all the way through the mounting member 220. In addition, the step 234 provides a place for excess sealant material to flow into when the drop ejector array devices 211 and 214 are affixed to the mounting member 220 to avoid having sealant material squeeze out at the first alignment edge 221 or the second alignment edge 223 respectively of the mounting member 220.

In other embodiments (not shown) a trench can be formed within the first endmost bridge 237 and the second endmost bridge 238 for providing a place for excess sealant material to flow into when the drop ejector array devices 211 and 214 are affixed to the mounting member 220.

Figure 7:
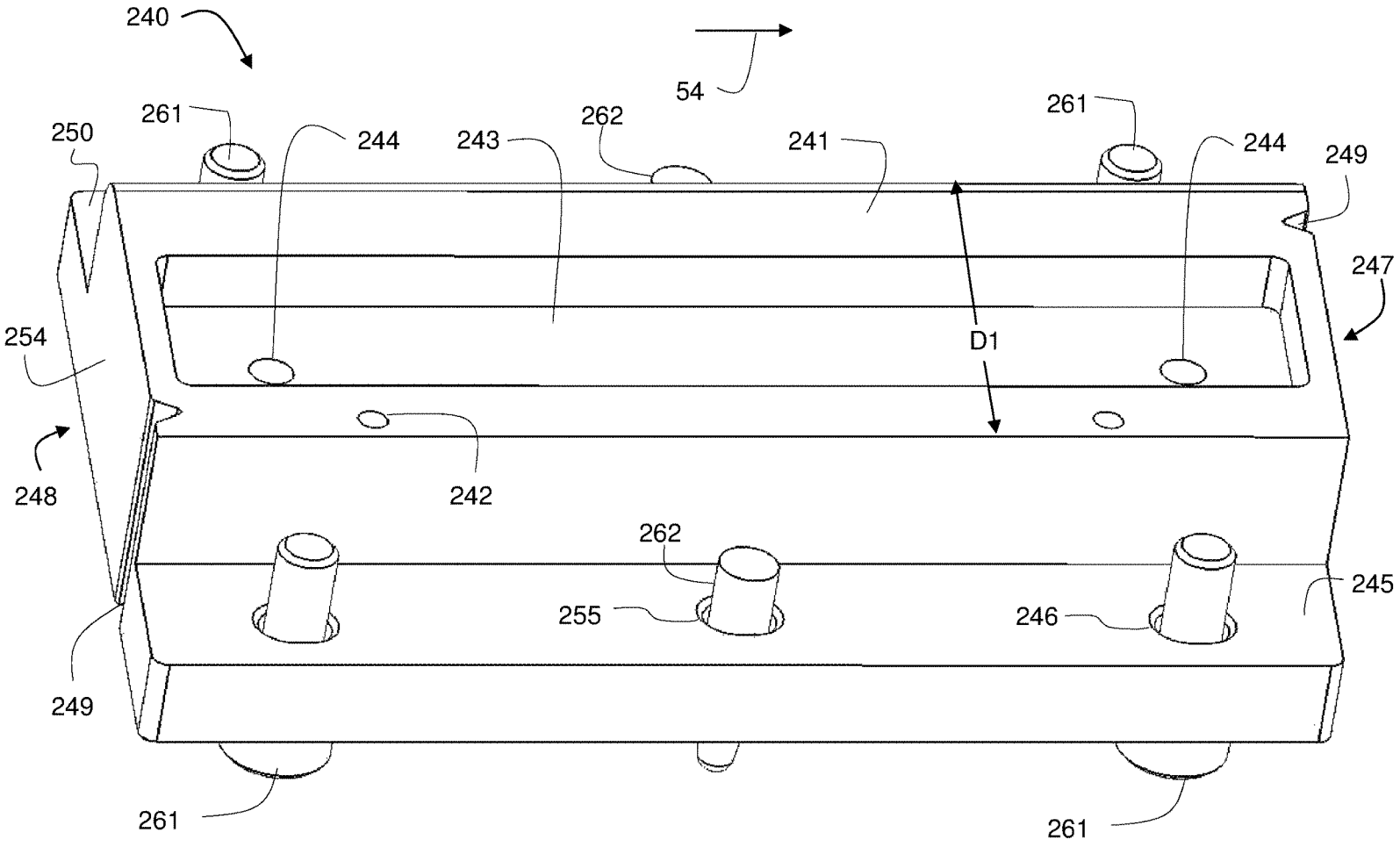
FIG. 7 shows a perspective of the manifold of the printhead unit of FIG. 4.

Mounting member 220 also includes mounting alignment holes 228. With reference also to FIG. 7, the mounting alignment holes 228 of mounting member 220 fit over alignment bumps 242 on an interface surface 241 of the manifold 240 in order to align the mounting member 220 to the manifold 240.

Mounting member 220 is typically made of a stiff material such as stainless steel or ceramic having a coefficient of thermal expansion that is similar to the coefficient of thermal expansion of the substrate of the drop ejector array device 210. Shaping of the mounting member 220 can be done using technologies such as laser cutting, electrical discharge machining, photo etching, or deep reactive ion etching.

Figure 5C:
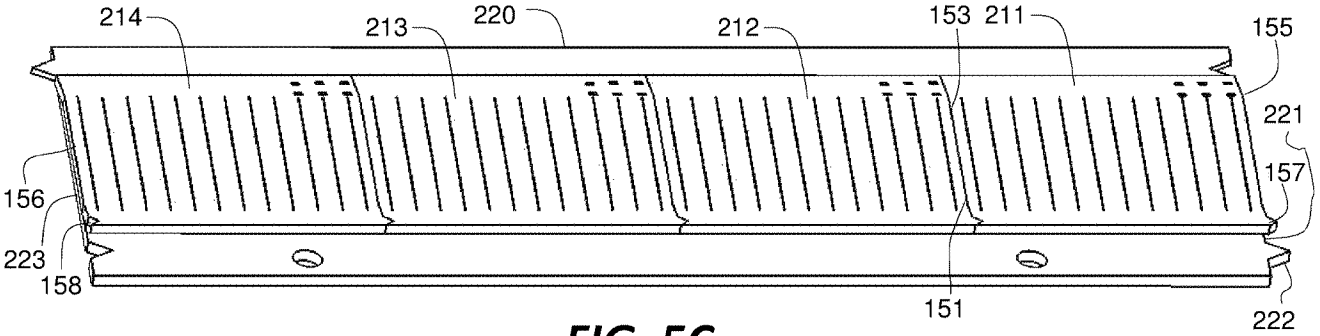
FIG. 5C a similar perspective as FIG. 5B with four drop ejector array devices affixed to the mounting member.

FIG. 5C shows a similar perspective as FIG. 5B, and shows drop ejector array devices 211, 212, 213 and 214 affixed to mounting member 220. Endmost first butting edge 155 of a first drop ejector array device 211 extends beyond first alignment edge 221 of mounting member 220 and endmost second butting edge 156 of an opposite drop ejector array device 214 extends beyond the second alignment edge 223 of mounting member 220. The first mechanical alignment feature of the endmost first butting edge 155 includes a jutting feature 157. The second mechanical alignment feature of the endmost second butting edge 156 includes a notch 158 that is substantially complementary to the jutting feature 157. Projection 222 extends outwardly from the first alignment edge 221 of the mounting member 220, and extends past the jutting feature 157 of the endmost first butting edge 155.

FIG. 7 shows a perspective of manifold 240 that is similar in orientation as FIG. 4 but without the mounting member 220 and the drop ejector array devices 210 attached to manifold 240. In the view of printhead unit 200 shown in FIG. 4, a back surface 229 (FIG. 5B) of mounting member 220 that is opposite mounting surface 225 (FIG. 5B) is affixed and fluidically sealed to the interface surface 241 (FIG. 7) of manifold 240. Ink ports 244 bring ink to an ink well 243 that is laterally surrounded by an ink well enclosure 254. In some embodiments both ink ports 244 are ink inlets to ink well 243. In other embodiments, one ink port 244 is an ink inlet and the other ink port 244 is an ink outlet. Manifold 240 has a stepped configuration having a first ledge 245 extending in one direction from the ink well enclosure 254 and a second ledge 250 extending in the opposite direction. The distance between first ledge 245 and second ledge 250 (i.e. the width of ink well enclosure 254) is D1. Clearance holes 246 are provided in the first ledge 245 and the second ledge 250 to accommodate screws 261 for attachment to a base 280 as described below with reference to FIGS. 9 and 11. Manifold alignment holes 255 are provided in first and second ledges 245 and 250 to accommodate dowel pins 262 for coarse alignment of the manifold 240 to the base 280. More generally, each printhead unit 200 includes at least two first locating features, such as the manifold alignment holes 255 in the first ledge 245 and the second ledge 250 for approximate positioning of the printhead unit 200 on the base 280 (FIG. 9).

Manifold 240 has a first end 247 and a second end 248 opposite the first end 247. As described below with reference to FIG. 11 showing a fully assembled hierarchically aligned inkjet printhead 300, a plurality of printhead units 200 are placed end to end with the first end 247 of the manifold 240 of one printhead unit 200 adjacent to the second end 248 of the manifold 240 of another printhead unit 200. In the embodiment of manifold 240 shown in FIG. 7 the first end 247 and the second end 248 each include clearance grooves 249. When a printhead unit 200 is being replaced in the fully assembled inkjet printhead, the clearance grooves 249 allow the projections 222 and 227 (FIG. 4) of adjacent printhead units 200 to pass through the clearance grooves 249 without mechanical interference as described below with reference to FIGS. 12A and 12B.

Figure 8:
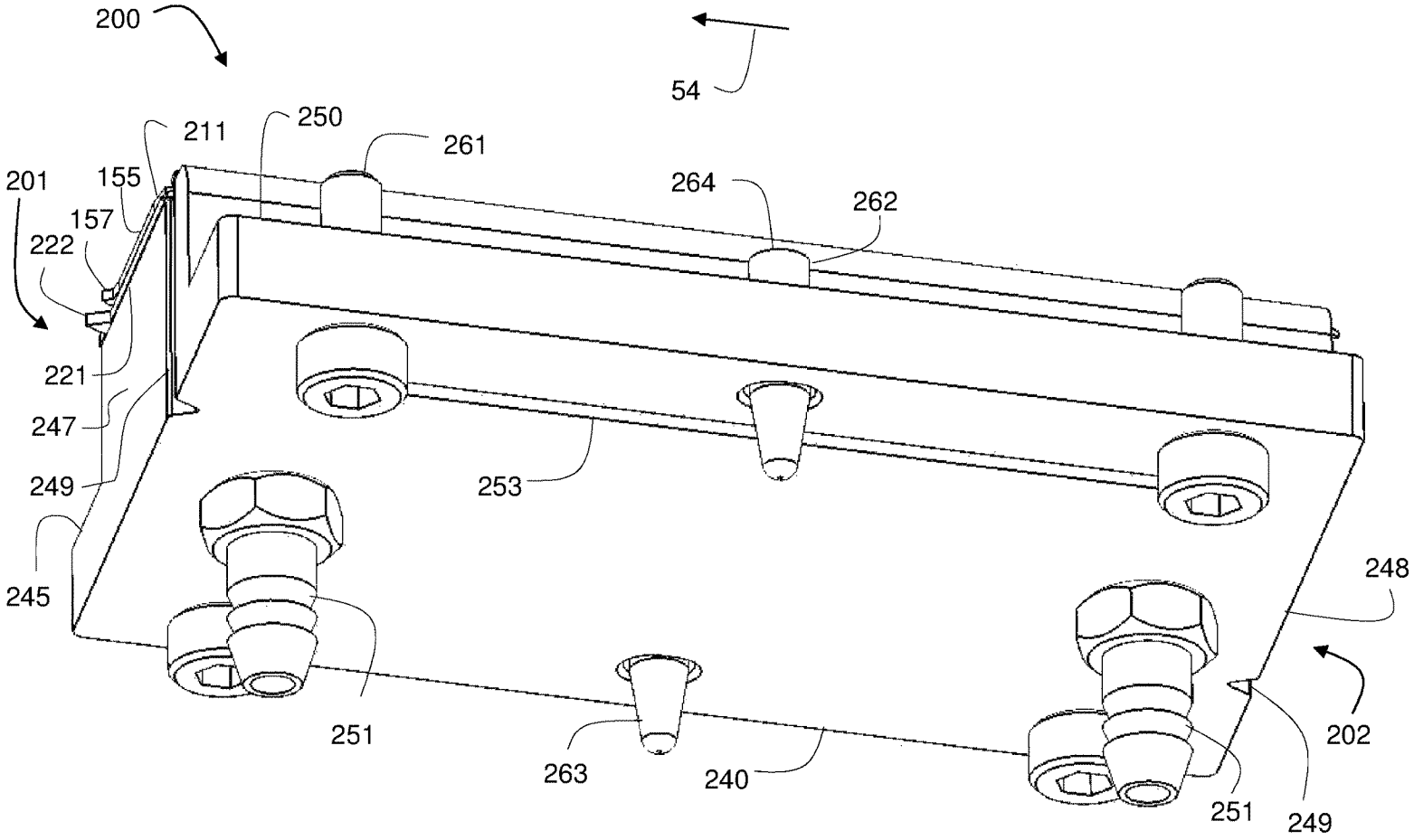
FIG. 8 shows a perspective of printhead unit that is rotated with respect to the orientation shown in FIG. 4.

FIG. 8 shows a perspective of printhead unit 200 that is rotated with respect to the orientation shown in FIG. 4. In FIG. 8 the endmost first butting edge 155 and the jutting feature 157 of drop ejector array device 211 (FIG. 5C) can be seen, but the other drop ejector array devices 212-214 are hidden from view. Similarly, the first alignment edge 221 and projection 222 of mounting member 220 can be seen, but the rest of the mounting member 220 is hidden from view. First alignment edge 221 of mounting member 220 extends beyond first end 247 of manifold 240, and endmost first butting edge 155 of drop ejector array device 211 extends beyond first alignment edge 221 of mounting member 220. Similarly, though not visible in FIG. 8, second alignment edge 223 of mounting member 220 extends beyond second end 248 of manifold 240, and endmost second butting edge 156 of drop ejector array device 214 extends beyond second alignment edge 223 of mounting member 220, as described above with reference to FIG. 5C. Therefore, when two printhead units 200 are placed end to end, the contact edges of the printhead units are the endmost first butting edge 155 of drop ejector array device 211 on one printhead unit and the endmost second butting edge 156 of drop ejector array device 214 on the adjacent printhead unit. This helps to ensure that misalignment of printhead unit components and debris between printhead units 200 are less likely to interfere with precise alignment of the drop ejector array devices on the two printhead units 200.

Projection 222, which extends outwardly from the first alignment edge 221 of mounting member 220, extends past the jutting feature 157 that extends from the endmost first butting edge 155. As a result, as two neighboring printhead units 200 are moved toward each other, projection 222 of one printhead unit 200 will enter niche 224 (FIG. 5C) of the neighboring printhead unit 200 before jutting feature 157 of drop ejector array device 211 of the first printhead unit enters notch 158 (FIG. 5C) of the adjacent drop ejector array device 214 of the neighboring printhead unit 200.

A closeness of fit between the projection 222 and the niche 224 is designed to be looser than a closeness of fit between the jutting feature 157 (i.e. the first mechanical alignment feature 152 of the drop ejector array device 211 of the first printhead unit 200) and the notch 158 (i.e. the second mechanical alignment feature 154 of the drop ejector array device 214 of the neighboring printhead unit 200). For example, a first closeness of fit between the jutting feature 157 and the notch 158 can be between zero and ten microns while a second closeness of fit between the projection 222 and the niche 224 can be between twenty and forty microns. In other words, after the projection 222 is fully inserted within the niche 224, it can still be moved twenty to forty microns within the niche 224. The projection 222 and the niche 224 provide a relatively coarser alignment between the first printhead unit 200 and the neighboring printhead unit 200. They serve to guide the two printhead units 200 into approximate alignment so that the smaller and more fragile jutting feature 157 of the drop ejector array device 211 of the first printhead unit 200 can enter the notch 158 of the drop ejector array device 214 of the neighboring printhead unit 200 without excessive mechanical interference that could damage the jutting feature 157. The jutting feature 157 and the notch 158, as well as contact between endmost first butting edge 155 with endmost second butting edge 156, provide a final alignment between the drop ejector arrays on the two printhead units 200 within ten microns.

Also shown in FIG. 8 are ink connectors 251, slit 253, and tapered ends 263 of dowel pins 262. Ink connectors 251 provide fluidic connection from ink source 190 (FIG. 2) to ink ports 244 in ink well 243 (FIG. 7). Slit 253 allows a flex circuit 290 (FIG. 12A) to pass through manifold 240 in order to provide electrical connection to the drop ejector array devices 210 on the printhead unit 200. Dowel pins 262 provide coarse alignment of the printhead units 200 to a base 280 as described below with reference to FIG. 11. The tapered ends 263 facilitate guiding the printhead units 200 into their approximate positions on the base 280. The non-tapered ends 264 can be press-fit into corresponding dowel pin holes 283 in base 280 (FIG. 9).

Figure 9:
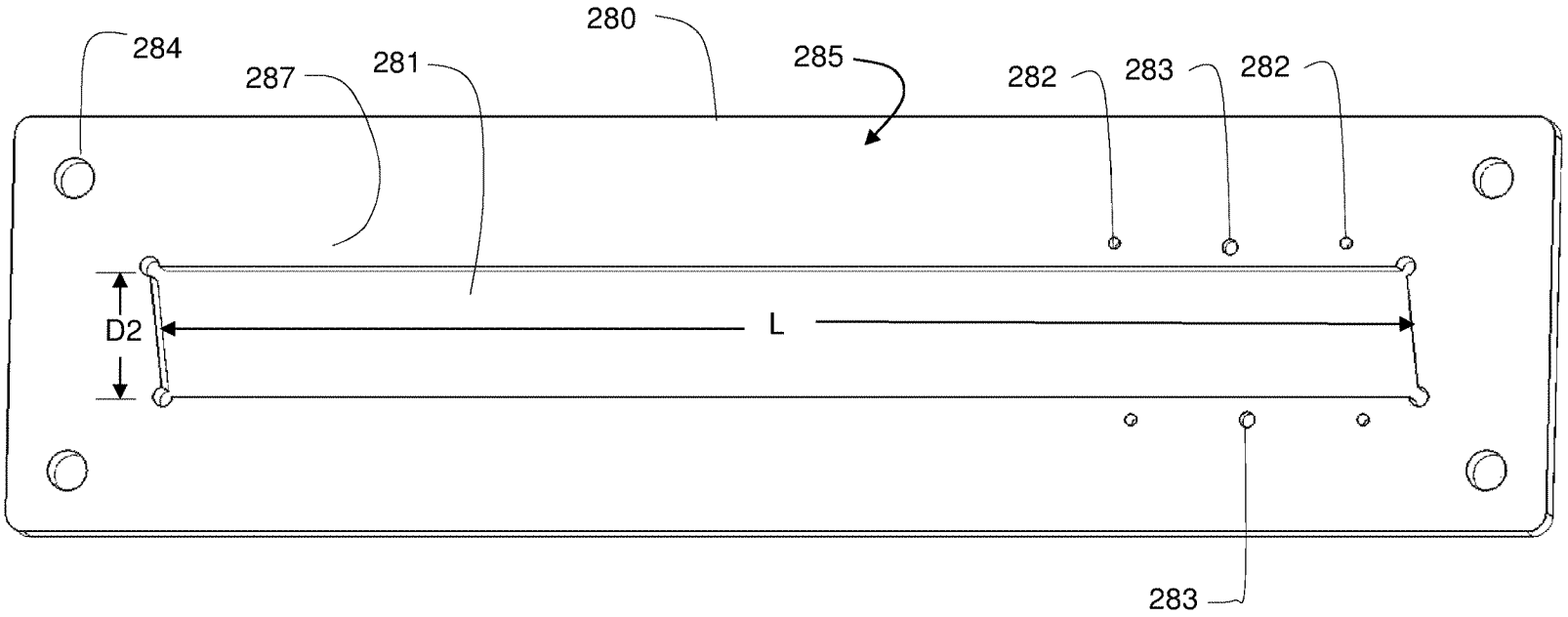
FIG. 9 shows an attachment side of a printhead base.

FIG. 9 shows an attachment side 285 of base 280 without any printhead units 200 attached. Base 280 has an elongated opening 281 having a width D2 that is slightly wider than the width D1 (FIG. 7) of ink well enclosure 254 of manifold 240. Thus the portion of printhead unit 200 (FIG. 4) including ink well enclosure 254, the mounting member 220 and the drop ejector arrays 210 can be inserted through the elongated opening 281, but the ledges 245 and 250 of manifold 240 will not fit through elongated opening 281. Attachment side 285 provides a support surface 287 for printhead units 200. In the example shown in FIG. 9, elongated opening 281 of base 280 is long enough to accommodate four printhead units 200 end to end, but in other embodiments (not shown) base 280 and elongated opening 281 can be sized to accommodate more or fewer printhead units 200 depending upon the desired overall printing length.

Figure 12A:
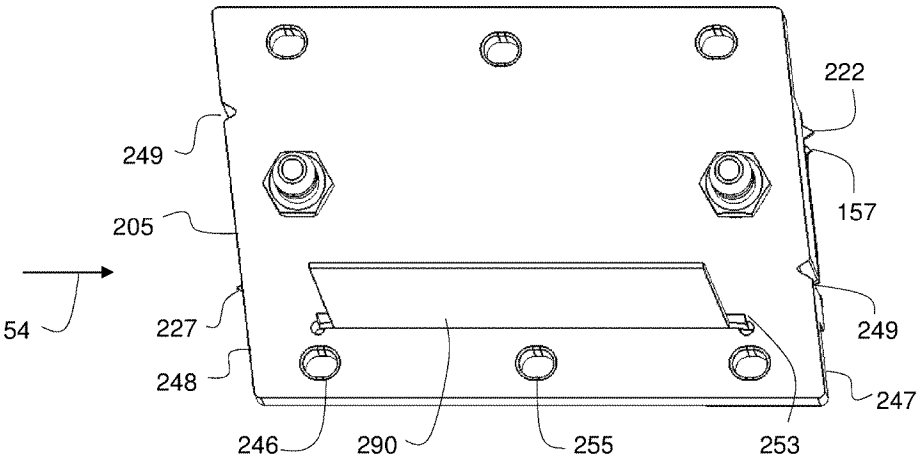
FIG. 12A shows an enlarged view of a single printhead unit.

For simplicity in FIG. 9 screw holes 282 and dowel pin holes 283 are shown for only one of the four printhead units 200. The non-tapered ends 264 of dowel pins 262 (FIG. 8) can be press-fit into dowel pin holes 283 in the support surface 287 of base 280. Dowel pins 262 function as second locating features that are included in the support surface 287 in the base 280. Different pairs of dowel pins 262 provide coarse alignment for the first locating features in each of the printhead units 200, i.e. for the manifold alignment holes 255 (FIG. 7). Both the first locating features (i.e. the axes of manifold alignment holes 255) and the second locating features (i.e. the axes of dowel pins 262) extend in a direction that is substantially perpendicular to the support surface 287 of the base 280. Dowel pins 262 (FIG. 8) are used to provide coarse alignment of the printhead unit 200 to the base 280. The fit between the dowel pins 262 and manifold alignment holes 255 (FIG. 7) is relatively loose, such that individual printhead units 200 can be moved relative to the base 280 by 150 to 200 microns, for example, after the printhead units 200 are placed over dowel pins 262. As can be seen in FIGS. 7 and 12A, clearance holes 246 and manifold alignment holes 255 are elongated along array direction 54 in order to allow position adjustment of printhead units 200 along the array direction. In other words, the closeness of fit between the first locating features (manifold alignment holes 255) and the second locating features (dowel pins 262) is looser than a closeness of fit between a projection 222 of a first printing unit 200 and a corresponding niche 224 of an adjacent second printing unit 200. Progressively finer alignment is then provided by the projections 222 and corresponding niches 224 of adjacent mounting members 220. Even finer alignment is provided by the jutting features 157, notches 158 and endmost butting edges 155 and 156 of adjacent drop ejector array devices on adjacent printhead units 200. After a printhead unit 200 is mechanically aligned relative to a neighboring printhead unit 200, screws 261 that are inserted through first and second ledges 245 and 250 (FIG. 8) of manifold 240 are tightened into screw holes 282 (FIG. 9) to attach the printhead unit 200 to base 280. Base 280 also includes mounting holes 284 for attaching the assembled printhead 300 (FIG. 10) to the framework of the printing system.

Figure 10:
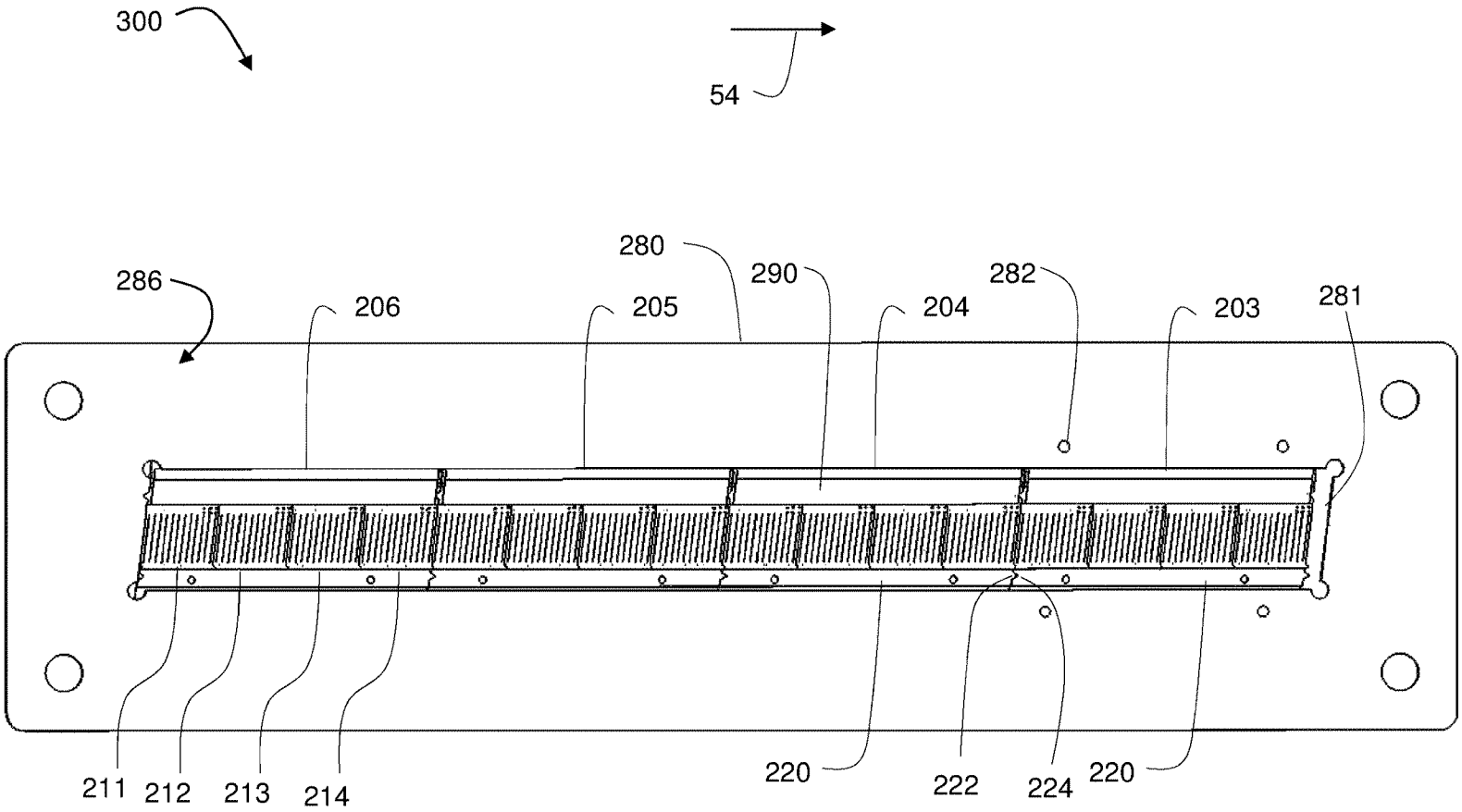
FIG. 10 shows an assembled hierarchically aligned inkjet printhead as seen from a device side of the base.

FIG. 10 shows an assembled hierarchically aligned inkjet printhead 300 as seen from a device side 286 of base 280. Four printhead units 203, 204, 205 and 206 have been inserted end to end from the opposing attachment side 285 of base 280 as described above with reference to FIG. 9. Printhead unit 203 has been coarsely aligned to base 280 by corresponding dowel pins 262 and attached to base 280 by screws 261 (FIG. 8) in screw holes 282 as described above. Then printhead unit 204 has been coarsely mechanically aligned to the base 280 by dowel pins 262 in manifold alignment holes 255 as described above. Printhead unit 204 is then aligned relative to adjacent printhead unit 203 by inserting projection 222 of its mounting member 220 into niche 224 of the mounting member 220 of printhead unit 203. The first and second mechanical alignment features 152 (i.e. jutting feature 157) and 154 (i.e. notch 158) of the drop ejector array devices 211 and 214 cannot be seen at the magnification used in FIG. 10, but the finest alignment relative to these features and the endmost butting edges 155 and 156 is then performed as described above relative to FIGS. 8-9. Then printhead unit 204 is tightened to base 280 using screws 261. Printhead units 205 and 206 are similarly successively mechanically aligned and attached to base 280.

As shown in FIG. 10, each of the four printhead units 203-206 has a flex circuit 290 that is attached to bond pads (not shown) on the four drop ejector array devices 211-214 for providing electrical interconnection. Flex circuits 290 can make connection to an intermediate interconnection board 107 as shown in FIG. 3. Ultimately, electrical interconnection is provided between each drop ejector array device 211-214 on each printhead unit 203-206 and controller 14 (FIGS. 2-3).

Figure 11:
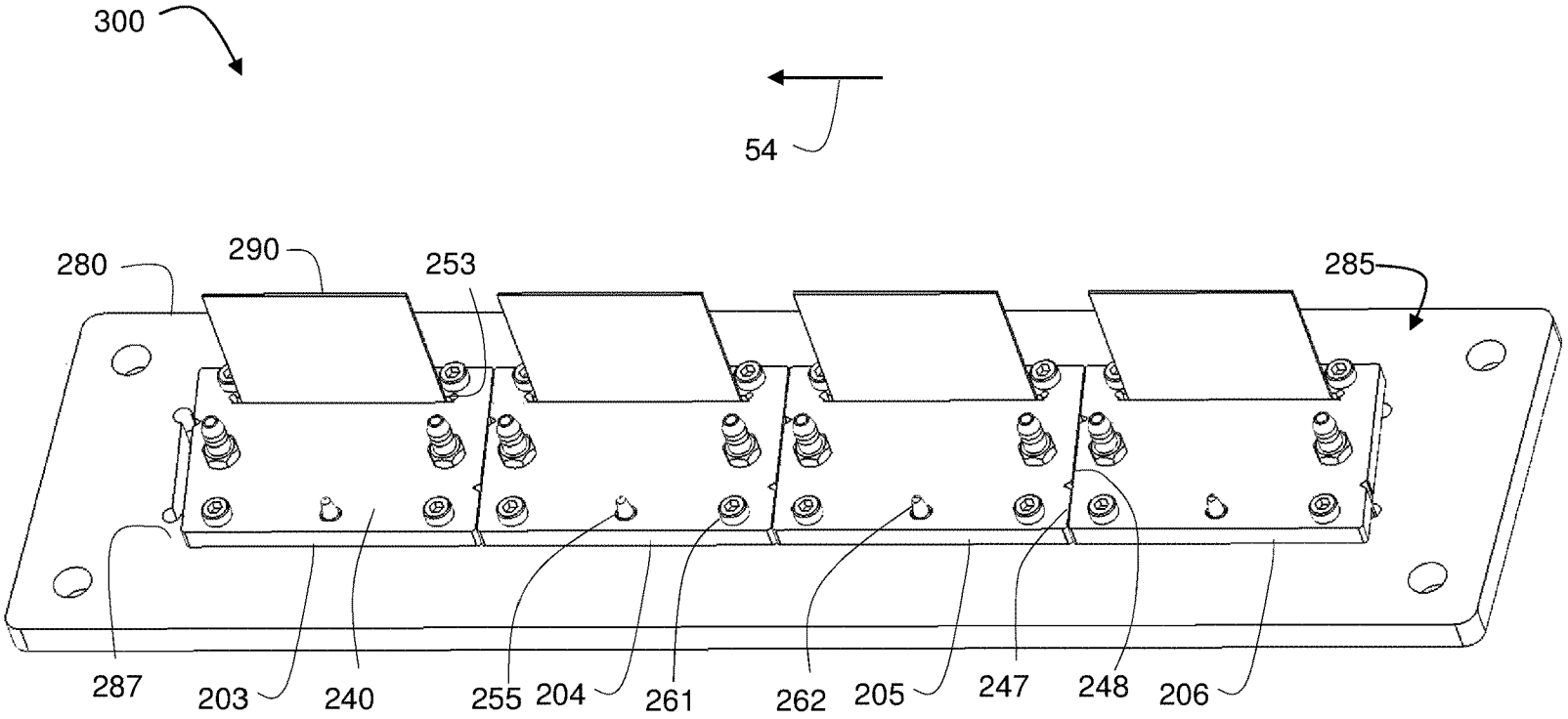
FIG. 11 shows a perspective of the assembled hierarchically aligned inkjet printhead of FIG. 10 as seen from the attachment side of the base.

FIG. 11 shows a perspective of the assembled hierarchically aligned inkjet printhead 300 as seen from the attachment side 285 of base 280. Flex circuits 290 are shown extending through slits 253 in manifolds 240. Dowel pins 262 extend from base 280 through manifold alignment holes 255 in the manifolds 240 of printhead units 203-206. Printhead units 203-206 are arranged end to end with first end 247 of the manifold 240 of one printhead unit being adjacent to second end 248 of the manifold 240 of the adjacent printhead unit. Screws 261 attach the printhead units to the support surface 287 of the base 280.

Figure 12B:
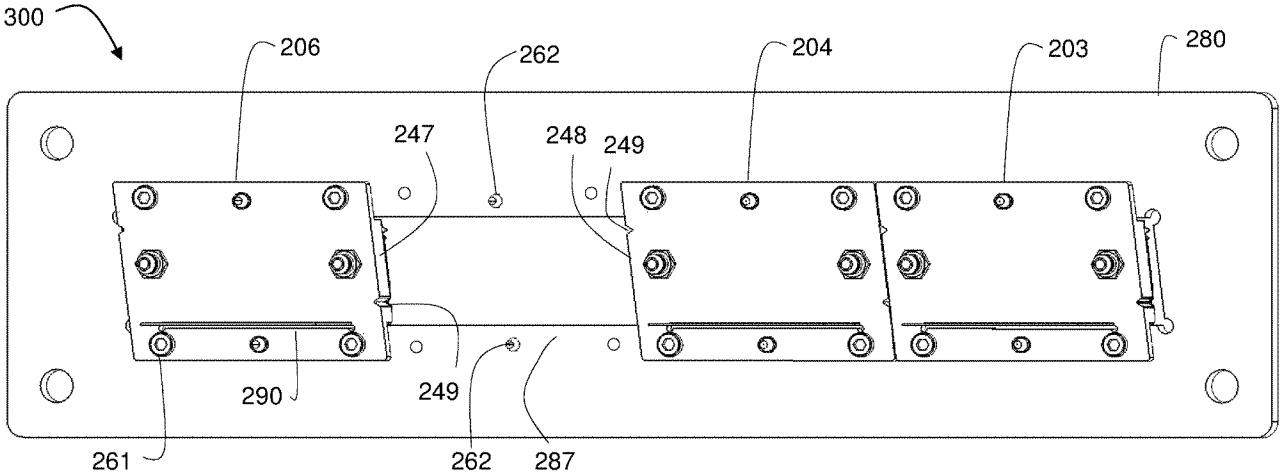
FIG. 12B shows an assembled hierarchically aligned inkjet printhead with one printhead unit removed.

FIG. 12A shows an enlarged view of a single printhead unit 205, and FIG. 12B shows printhead units 203, 204 and 206 attached to base 280 in order to illustrate the capability of removing a printhead unit from a hierarchically aligned inkjet printhead 300 and easily replacing it with another printhead unit that is aligned to the other printhead units. FIG. 12A shows the projection 222 of mounting member 220 (FIG. 5B) and jutting feature 157 of drop ejector array 211 (FIG. 5C) extending beyond first end 247 of manifold 240, as well as projection 227 of mounting member 220 (FIG. 5B) extending beyond second end 248 of manifold 240. In order to remove the old printhead unit 205, screws 261 are loosened on printhead unit 206, and screws 261 are removed from printhead unit 205 so that printhead unit 206 can be slid away from printhead unit 205 and printhead unit 205 can be slid away from printhead unit 204 and lifted away from base 280. Clearance groove 249 on the right side of printhead unit 206 and clearance groove 249 on the left side of printhead unit 204 allow projections 227 and 222 respectively of printhead unit 205 to pass during removal of printhead unit 205. A new printhead unit 205 is placed over dowel pins 262 and brought into contact with the support surface 287 of base 280 to provide coarse alignment. Screws 261 are inserted through clearance holes 246 and loosely tightened. Progressively finer alignment is then performed mechanically using projections 222 and 227 that are inserted into niches 224 and 226 of mounting member 220 (FIG. 5B), jutting feature 157 and second mechanical feature 154, and endmost first and second butting edges 155 and 156 as described above with reference to FIGS. 8-10. Then the screws 261 are tightened to complete the replacement of printhead unit 205 without requiring any complex jigging or optical alignment.

Figure 13:
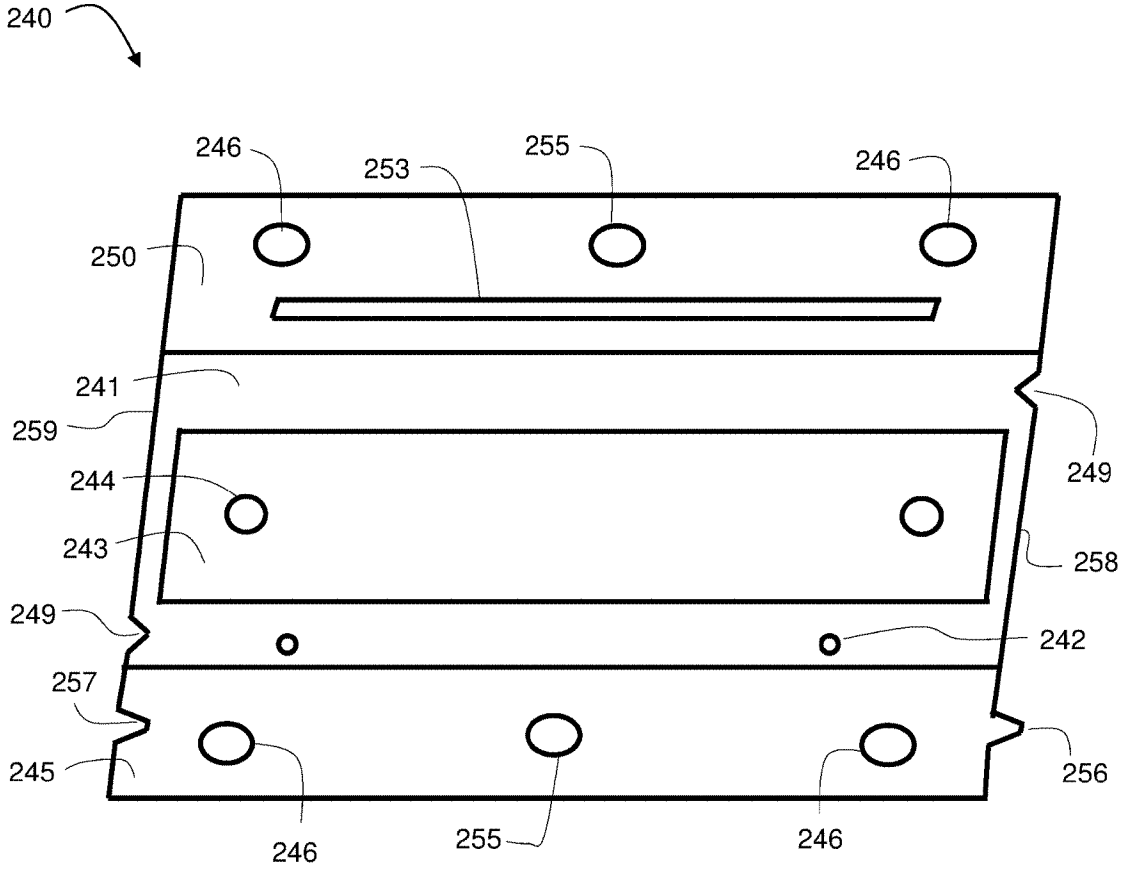
FIG. 13 shows a plan view of another embodiment of a manifold.

In the embodiments described above, the projection 222 and the niche 224 of printhead unit 200 are formed as part of the mounting member 220. FIG. 13 shows a plan view of another example of a manifold 240 having an outwardly-extending alignment feature 256 from a first alignment edge 258 and a corresponding inwardly-extending alignment feature 257 extending from a second alignment edge 259 and having a shape that is substantially complementary to the outwardly-extending alignment feature 256. First alignment edge 258 and second alignment edge 259 are substantially parallel to the endmost first and endmost second butting edges 155 and 156 (FIG. 5C) of the corresponding drop ejector array device(s).

In some embodiments outwardly-extending alignment feature 256 functions as the outwardly-extending projection and inwardly-extending alignment feature 257 functions as the niche of printhead unit 200, e.g. for configurations of printhead units 200 where there is no mounting member 220. Mounting member 220 provides a common mounting surface 225 for embodiments where there is a plurality of drop ejector array devices 210 in each printing unit 200. For configurations where each of the printhead units 200 in a hierarchically aligned inkjet printhead has only one drop ejector array device 210, the drop ejector array device 210 can be directly affixed and fluidically connected to the ink manifold 240 with no interposed mounting member 220. In other embodiments there can be a plurality of drop ejector array devices mounted on a mounting member 220, but the mounting member 220 does not include an outwardly-extending projection and a corresponding niche.

In still other embodiments the mounting member 220 has a projection 222 extending outwardly from a first alignment edge 221 and a niche 224 extending inwardly from an opposing second alignment edge 223 of the mounting member 220, as described above with reference to FIG. 5B, and in addition, the manifold 240 has an outwardly-extending alignment feature 256 and an inwardly-extending alignment feature 257 as described above with reference to FIG. 13. In such embodiments, in order to clarify terminology, the outwardly-extending alignment feature 256 is referred to herein as a protuberance that extends outwardly from a first alignment edge 258 of the ink manifold 240. Similarly, the inwardly-extending alignment feature 257 is referred to herein as a recess that extends inwardly from a second alignment edge 259 of the ink manifold 240.

In various embodiments described above, outwardly-extending and inwardly-extending features are said to have substantially complementary shapes. Such a configuration enables a projection 222 of one printhead unit 200, for example, to fit into a niche 224 of an adjacent printhead unit 200, and help to align the two printhead units 200 relative to one another. What is meant herein by substantially complementary is that the outwardly-extending feature has a size and shape that would allow it to fit into the corresponding inwardly-extending feature with a desired degree of closeness of fit to facilitate relative alignment of two printhead units 200. As described above with reference to FIG. 5C, a projection 222 and a corresponding niche 224 of a mounting member 220 are designed with a closeness of fit of twenty to forty microns. In order to provide approximate alignment without causing mechanical interferences that would hinder the finer alignment by the jutting feature 157 and the notch 158 on the drop ejector array devices 211 and 214, projection 222 should fit entirely within niche 224. In other words the size of the projection 222 is smaller than the niche 224. However, its size is not arbitrarily smaller. When jutting feature 157 is in contact with notch 158, there will be a gap of 20 to 40 microns between projection 222 and niche 224. In addition, the shape of the projection 222 does not need to be the same as the shape of the niche 224. For example, if the niche 224 has a triangular shape as shown in FIG. 5C, projection 222 can also have a triangular shape, or it can have its tip truncated or rounded for example. Even if the size and shape of the projection 222 is different from the shape of the niche 224, the projection 222 and the niche 224 are considered herein to be substantially complementary if the projection 222 fits into the niche 224 with a desired degree of closeness of fit to facilitate relative alignment of two printhead units 200.

A method of assembling a hierarchically aligned inkjet printhead 300 will now be described with reference to FIGS. 4, 5A, 5C, 8, 10 and 11. First, a plurality of printhead units 200 are assembled. This includes affixing a plurality of drop ejector array devices 210 to a mounting member 220. Adjacent drop ejector array devices 210 in the printhead unit 200 are butted end to end at adjacent first and second butting edges 151 and 153 and are mechanically aligned using first and second mechanical alignment features 152 and 154 of the drop ejector array devices 210. Printhead unit assembly also includes affixing the mounting member 220 to an ink manifold 240 such that the ink manifold 240 is fluidically connected to each of the drop ejector array devices 210 in the printhead unit 200, as described above with reference to FIG. 5B. A first printhead unit 200 is positioned on a base 280 by loosely engaging a plurality of first locating features, such as manifold alignment holes 255, with a corresponding first plurality of second locating features, such as a first pair of dowel pins 262, on the base 280. A second printhead unit 200 is positioned on the base 280 by loosely engaging a plurality of first locating features, such as manifold alignment holes 255, with a corresponding second plurality of second locating features, such as a second pair of dowel pins 262, on the base 280. The second printhead unit 200 is then pushed to provide a relative motion along the array direction 54 toward the first printhead unit 200. This relative motion is guided during a first time interval by inserting an outwardly-extending projection 222 of a first alignment edge 201 of the first printhead unit 200 into a substantially complementary niche 224 in an adjacent second alignment edge 202 of the second printhead unit. Pushing of the second printhead unit 200 toward the first printhead unit 200 is continued until a first mechanical alignment feature, such as jutting feature 157 on an endmost first butting edge 155 of the first printhead unit 200 interlocks with an adjacent second mechanical alignment feature, such as notch 158 having a substantially complementary shape on an endmost second butting edge 156 of the second printhead unit 200. The first and second printhead units 200 are secured to the base 280, for example using screws 261. Typically the first printhead unit 200 is secured to the base 280 before the second printhead unit 200 is moved toward it, and the second printhead unit 200 is secured to the base 280 after the interlocking of the mechanical alignment features 157 and 158.

Although in the examples described above with reference to FIGS. 7-11 include a plurality of first locating features, such as manifold alignment holes 255 for each printhead unit 220, as well as a corresponding plurality of second locating features such as a pair of dowel pins, in other embodiments (not shown) a single manifold alignment hole 255 and a single dowel pin 262 can be used for providing rough alignment on the base 280.

In general, hierarchical mechanical alignment proceeds from the loosest closeness of fit features progressively toward finer alignment with more closely fitting features. In embodiments where the mounting member 220 includes a projection 222 and a niche 224, and additionally the manifold 240 includes a protuberance 256 and a recess 257 (FIG. 13), typically the closeness of fit of the protuberance 256 and recess 257 is around 60 to 100 microns, i.e. a looser fit than the 20 to 40 microns closeness of fit between the projection 222 and the niche 224 of the mounting member. In such embodiments the second printhead unit 200 is coarsely aligned to the base 280 using dowel pins 262 having a closeness of fit with manifold alignment holes 255 of 150 to 200 microns, for example. Then the second printhead unit 200 is pushed to provide the relative motion toward the first printhead unit 200, such that the relative motion is guided during a second time interval by inserting the protuberance 256 in the manifold 240 of the first printhead unit 200 into a substantially complementary recess 257 in the manifold 240 of the second printhead unit 200. Then as described above, during a first time interval following the second time interval, the relative motion is guided by the insertion of a projection 222 of a mounting member 220 into a niche 224 of an adjacent mounting member 220 until the interlocking of the mechanical features 157 and 158 on adjacent drop ejector array devices.

The invention has been described in detail with particular reference to certain preferred embodiments thereof, but it will be understood that variations and modifications can be effected within the spirit and scope of the invention.

The invention claimed is:

1. A hierarchically aligned inkjet printhead comprising:

a plurality of printhead units, each printhead unit including:

a plurality of drop ejector array devices, each drop ejector array device including:

a substrate having a substrate surface;

at least one drop ejector array formed on the substrate surface;

a first butting edge having a first mechanical alignment feature; and a second butting edge having a second mechanical alignment feature;

an ink manifold that is fluidically connected to each of the plurality of drop ejector array devices in the printhead unit;

a mounting member to which each of the plurality of drop ejector array devices in the printhead unit are affixed; and a pair of opposing alignment edges that are substantially parallel to the first butting edges and the second butting edges of the plurality of drop ejector array devices, wherein a first of the opposing alignment edges includes an outwardly-extending projection, and wherein a second of the opposing alignment edges includes a niche that is substantially complementary to the projection, and wherein a second closeness of fit between the projection and the niche is looser than a first closeness of fit between the first mechanical alignment feature and the second mechanical alignment feature; and a base having a support surface that holds the plurality of printhead units.

2. The hierarchically aligned inkjet printhead of claim 1, the pair of opposing alignment edges being located on the ink manifold, wherein the projection extends outwardly from a first alignment edge of the ink manifold, and the niche extends inwardly from an opposing second alignment edge of the ink manifold.

3. The hierarchically aligned inkjet printhead of claim 1, the opposing alignment edges being located on the mounting member, wherein the projection extends outwardly from a first alignment edge of the mounting member, and the niche extends inwardly from an opposing second alignment edge of the mounting member.

4. The hierarchically aligned inkjet printhead of claim 3, the ink manifold further including:

a first manifold alignment edge having a protuberance that extends outwardly; and a second manifold alignment edge having a recess that extends inwardly, wherein the recess is substantially complementary to the protuberance.

5. The hierarchically aligned inkjet printhead of claim 1, each printhead unit further including at least one first locating feature for positioning on the base, wherein the support surface of the base includes at least one second locating feature corresponding to the at least one first locating feature of each of the printhead units.

6. The hierarchically aligned inkjet printhead of claim 5, wherein the at least one first locating feature and the at least one second locating feature extend in a direction that is substantially perpendicular to the support surface of the base.

7. The hierarchically aligned inkjet printhead of claim 5, wherein a third closeness of fit between the at least one first locating feature and the at least one second locating feature is looser than a second closeness of fit between a projection of a first printing unit and a corresponding niche of an adjacent second printing unit.

8. The hierarchically aligned inkjet printhead of claim 1, wherein for each printhead unit, an endmost first butting edge of a first drop ejector array device extends beyond the first of the opposing alignment edges, and an endmost second butting edge of an opposite drop ejector array device extends beyond the second of the opposing alignment edges.

9. The hierarchically aligned inkjet printhead of claim 8, the first mechanical alignment feature of the endmost first butting edge including a jutting feature, wherein the outwardly-extending projection of the first of the opposing alignment edges extends past the jutting feature of the endmost first butting edge.

10. The hierarchically aligned inkjet printhead of claim 1, wherein the mounting member of each printhead unit includes:

a plurality of groups of ink passages, each group including at least one ink passage, wherein each group of ink passages corresponds to one of the plurality of drop ejector array devices;

at least one interior bridge, each interior bridge being disposed between adjacent groups of ink passages and configured to provide a sealing surface for a first butting edge of a first drop ejector array device and for a second butting edge of an adjacent drop ejector array device;

a first endmost bridge configured to provide a sealing surface for an endmost first butting edge; and a second endmost bridge configured to provide a sealing surface for an endmost second butting edge.

11. The hierarchically aligned inkjet printhead of claim 10, wherein the interior bridges have a wall width w, and wherein the first and second endmost bridges have a wall width that is less than w.

12. The hierarchically aligned inkjet printhead of claim 10, wherein each of the first and second endmost bridges includes a partial-depth step.

13. The hierarchically aligned inkjet printhead of claim 1, wherein each printhead unit further includes a clearance groove that is aligned with the niche.

14. The hierarchically aligned inkjet printhead of claim 1, wherein each printhead unit further includes:

a flex circuit that is connected to each of the drop ejector array devices; and a slit in the ink manifold through which the flex circuit passes.

15. The hierarchically aligned inkjet printhead of claim 1, wherein each of the plurality of drop ejector array devices within each printhead unit is aligned end-to-end along an array direction, and wherein each of the plurality of printhead units is aligned end-to-end along the array direction.

16. A hierarchically aligned inkjet printhead comprising:

a plurality of printhead units, each printhead unit including:

at least one drop ejector array device, each drop ejector array device including:

a substrate having a substrate surface;

at least one drop ejector array formed on the substrate surface;

a first butting edge having a first mechanical alignment feature; and a second butting edge having a second mechanical alignment feature;

an ink manifold that is fluidically connected to each of the at least one drop ejector array devices in the printhead unit; and a pair of opposing alignment edges that are substantially parallel to the first butting edge and the second butting edge of the at least one drop ejector array device, wherein a first of the opposing alignment edges includes an outwardly-extending projection, and wherein a second of the opposing alignment edges includes a niche that is substantially complementary to the first projection, and wherein a second closeness of fit between the projection and the niche is looser than a first closeness of fit between the first mechanical alignment feature and the second mechanical alignment feature; and a base having a support surface that holds the plurality of printhead units.

17. A method of assembling a hierarchically aligned inkjet printhead, the method comprising:

assembling a plurality of printhead units, each printhead unit being assembled by:

affixing a plurality of drop ejector array devices to a mounting member, wherein adjacent drop ejector array devices in the printhead unit are butted end to end at adjacent butting edges, and are mechanically aligned using mechanical alignment features on the butting edges of the drop ejector array devices; and affixing the mounting member to an ink manifold such that the ink manifold is fluidically connected to each of the drop ejector array devices in the printhead unit;

positioning a first printhead unit on a base by loosely engaging a plurality of first locating features on the first printhead unit with a corresponding first plurality of second locating features on the base;

positioning a second printhead unit on the base by loosely engaging a plurality of first locating features on the second printhead unit with a corresponding second plurality of second locating features on the base;

pushing the second printhead unit to produce a relative motion toward the first printhead unit, wherein the relative motion is guided during a first time interval by inserting an outwardly extending projection of a first alignment edge of the first printhead unit into a substantially complementary niche in an adjacent second alignment edge of the second printhead unit;

continuing to push the second printhead unit toward the first printhead unit until a mechanical alignment feature on an endmost first butting edge of the first printhead unit interlocks with an adjacent substantially complementary mechanical alignment feature on an endmost second butting edge of the second printhead unit; and securing the first printhead unit and the second printhead unit to the base.

18. The method of claim 17, wherein the projection extends outwardly from the mounting member of the first printhead unit, and the niche extends inwardly into the mounting member of the second printhead unit, the method further comprising:

pushing the second printhead unit to produce the relative motion toward the first printhead unit, wherein the relative motion is guided during a second time interval by inserting a protuberance from the ink manifold of the first printhead unit into a substantially complementary recess in the ink manifold of the second printhead unit.

19. The method of claim 18, wherein the first time interval occurs after the second time interval.

* * * * *